US006808500B1

(12) United States Patent
Cheng-Yi et al.

(10) Patent No.: US 6,808,500 B1
(45) Date of Patent: Oct. 26, 2004

(54) ROLLER MASSAGER HAVING ROCKING OR KNEADING MASSAGING MOTIONS

(76) Inventors: Yu Cheng-Yi, P.O. Box 453, Taichung (TW); Huang Chia-Min, P.O. Box 453, Taichung (TW)

( * ) Notice: Subject to any disclaimer, the term of this patent is extended or adjusted under 35 U.S.C. 154(b) by 0 days.

(21) Appl. No.: 10/400,684

(22) Filed: Mar. 28, 2003

(51) Int. Cl.[7] ..... A61H 15/00

(52) U.S. Cl. ..... 601/99; 601/102; 601/116; 601/126; 601/134

(58) Field of Search ..... 601/50, 51, 52, 601/61, 63, 97–99, 100–103, 115, 116, 118, 122, 134, 126

(56) References Cited

U.S. PATENT DOCUMENTS 4,422,449 A * 12/1983 Hamabe ..... 601/99
4,718,408 A * 1/1988 Barreiro ..... 601/99
5,971,944 A * 10/1999 Chang ..... 601/90
6,656,140 B2 * 12/2003 Oguma et al. ..... 601/99

* cited by examiner

*Primary Examiner*—Danton D. DeMille
*Assistant Examiner*—Quang D Thanh
(74) *Attorney, Agent, or Firm*—Charles E. Baxley

(57) ABSTRACT

This creation is to provide a kind of roller massager structure improvement, which is primarily consisting of a seat body, a drive motor, a sliding seat, a second drive motor and a rocker arm type massaging roller set. The massaging roller sets are pivoted at the ends of a drive rod and is driven by the second drive motor indirectly, which is characterized by two pilot end heads eccentrically fitted at the two ends of the drive rod respectively, while a pilot end head at one end is provided with a radial slot, together with a bolt installed on the drive rod, that pilot end head can rotate itself depending on the different rotating directions of the drive rod, thus change the relative attitude to the pilot end head at another end; through this, the entire set can accomplish the practical improvements of achieving motions of rising and sinking, as well as automatic switching between two massaging modes rocking and kneading.

1 Claim, 7 Drawing Sheets

ROLLER MASSAGER HAVING ROCKING OR KNEADING MASSAGING MOTIONS

BACKGROUND OF THE INVENTION

1. Field of the Invention

This creation is about a kind of massager, specifically a new design of rock arm type roller massager.

2. Description of Related Art

Whereas the commonly adopted structure of massager for performing massaging motions on the back and waist of human body, particularly the kind of rocker arm type roller massager, as shown in FIG. 1, is using the rotations of a worm 10 to drive a rocker arm type roller set 11 for executing reciprocating displacement movements, hence enabling the rollers 12 on that roller set 11 to carry out rolling massaging on the back of a human body, in view of the fact that those rollers 12 can only provide straight line type rolling massaging along with the reciprocating linear movements of the roller seat body 13, obviously the massaging effects that are provided to the user are considerably simple and limited, thus such product design is deemed far less than perfect.

Therefore, how to develop a kind of more ideal and practical rocker arm type massager structure should be something that is desired by the consumers, and should be the goal and direction of development and creation by the efforts of the concerned business.

SUMMARY OF THE INVENTION

For enabling your respectable examiners to have further understanding and knowledge on the purpose, features and effects of this creation, detailed descriptions are hereby given in following together with illustrations in figures:

Firstly, as per the kind of roller massager structure improvement in this creation as demonstrated in FIGS. 2, 3, the new roller massager is primarily consisting of a seat body 20, a drive motor 21, a worm 22, a sliding seat 23, a second drive motor 24 and two rock arm type massaging roller sets 30, 301; of which, the sliding seat 23 is matching with the worm 22 capable of sliding back and forth along with the worm's rotating; the second drive motor 24 can drive a drive rod 26 to rotate through a turning gear set 25, and the rocker arm type massaging roller sets 30, 301 are pivoted at the ends of the drive rod 26; the main features are:

Two pilot end heads 40, 41 are fitted at the two ends of the drive rod 26 in opposite positions, their inner sides are provided with an eccentric hole 42 for fitting on the drive rod 26 end, the outer sides are cut into an inclined end surface 43 with a projecting stud 44, in order to limit the positions of the massaging roller set's rocker arms 31 through a locking set of lining ring 32 and nut 33 after being pivot-connected. Those two pilot end heads 40, 41 are radially locked onto the drive rod 26 by bolts 45, 46. One of the pilot end heads 41 is further provided with a radial slot 47 cutting across the eccentric hole 42, while the clockwise, counterclockwise extreme ends 471, 472 of that slot 47 are so positioned that that pilot end head 41 will be limited by the bolt 46 after rotating 180°. Accordingly, differences in the height and the inclined end surface 43 attitude will be generated between that pilot end head 41 and another pilot end head 40 through clockwise and counterclockwise rotations of the former, hence the rocker arm type roller sets will generate parallel rocking or symmetric kneading movements.

DETAILED DESCRIPTION OF THE INVENTION

Figure 1:
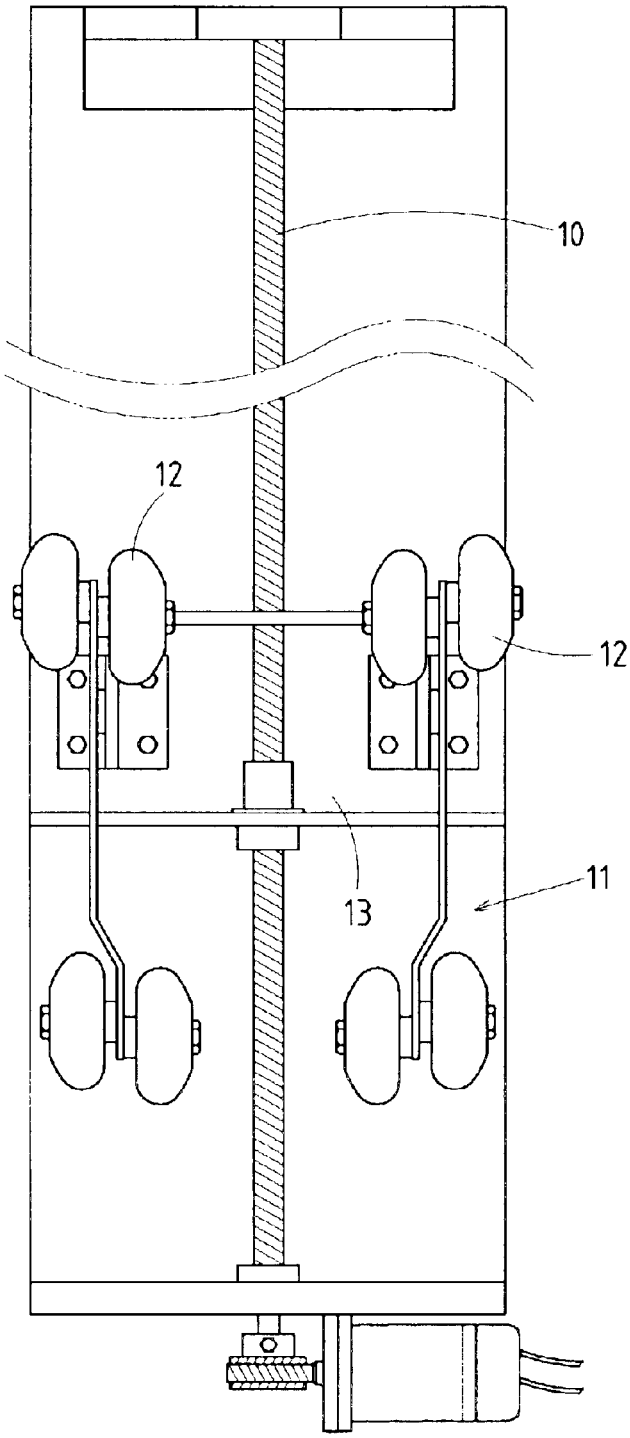
FIG. 1 PRIOR ART
FIG. 1 plan schematic of the assembly of the customarily used structure.
Figure 2:
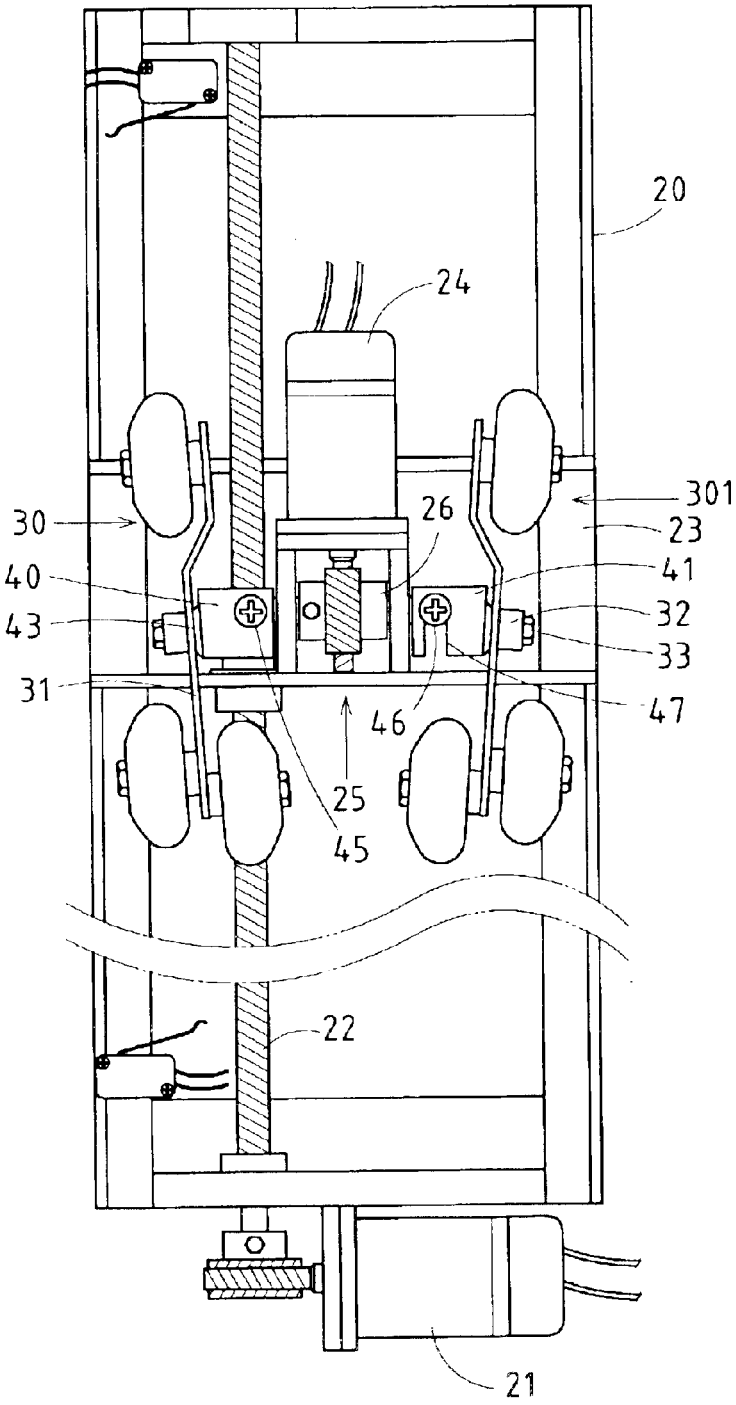
FIG. 2 plan schematic of the assembly of this creation.
Figure 3:
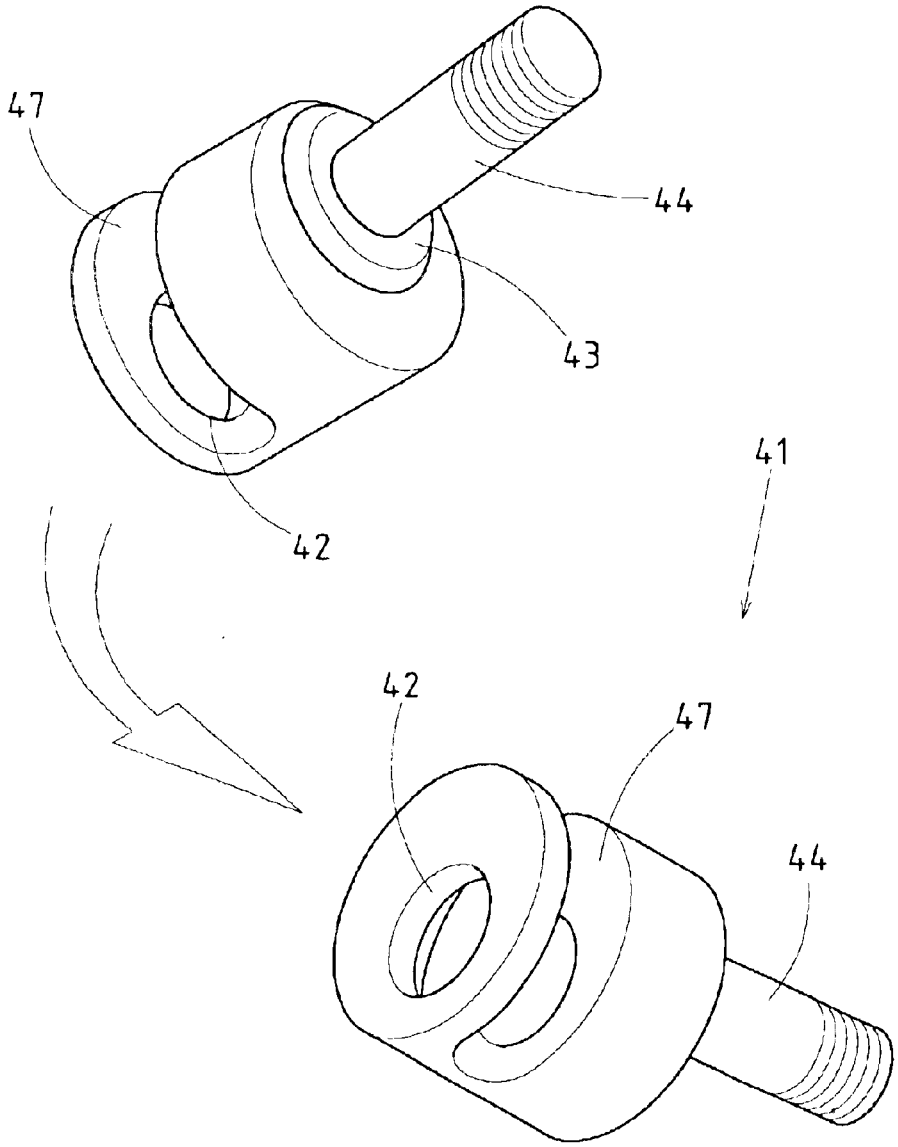
FIG. 3 stereoscopic schematic of the pilot end head of this creation.
Figure 4A:
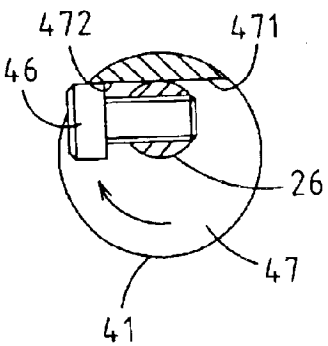
FIG. 4 structure section view of this creation in parallel rocking movement mode and FIG. 4A partially plan cross-sectional view of FIG. 4.
Figure 4:
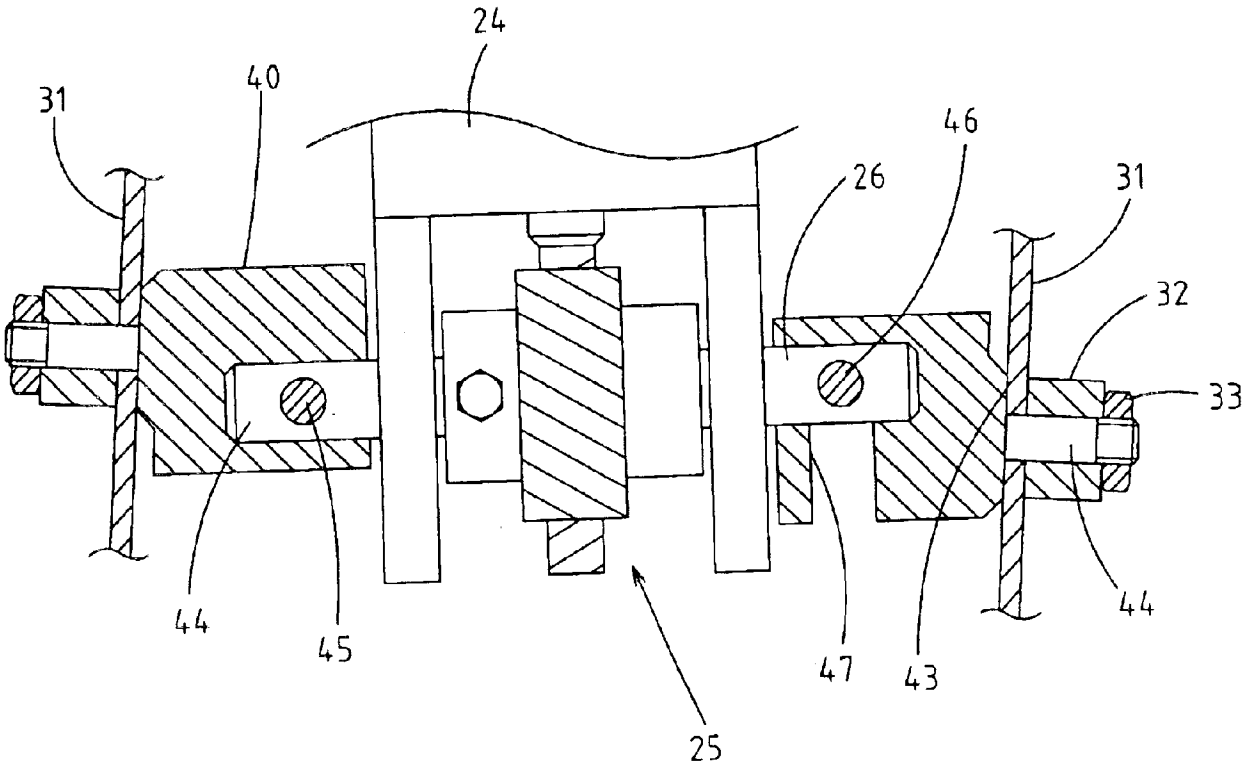
Figure 5:
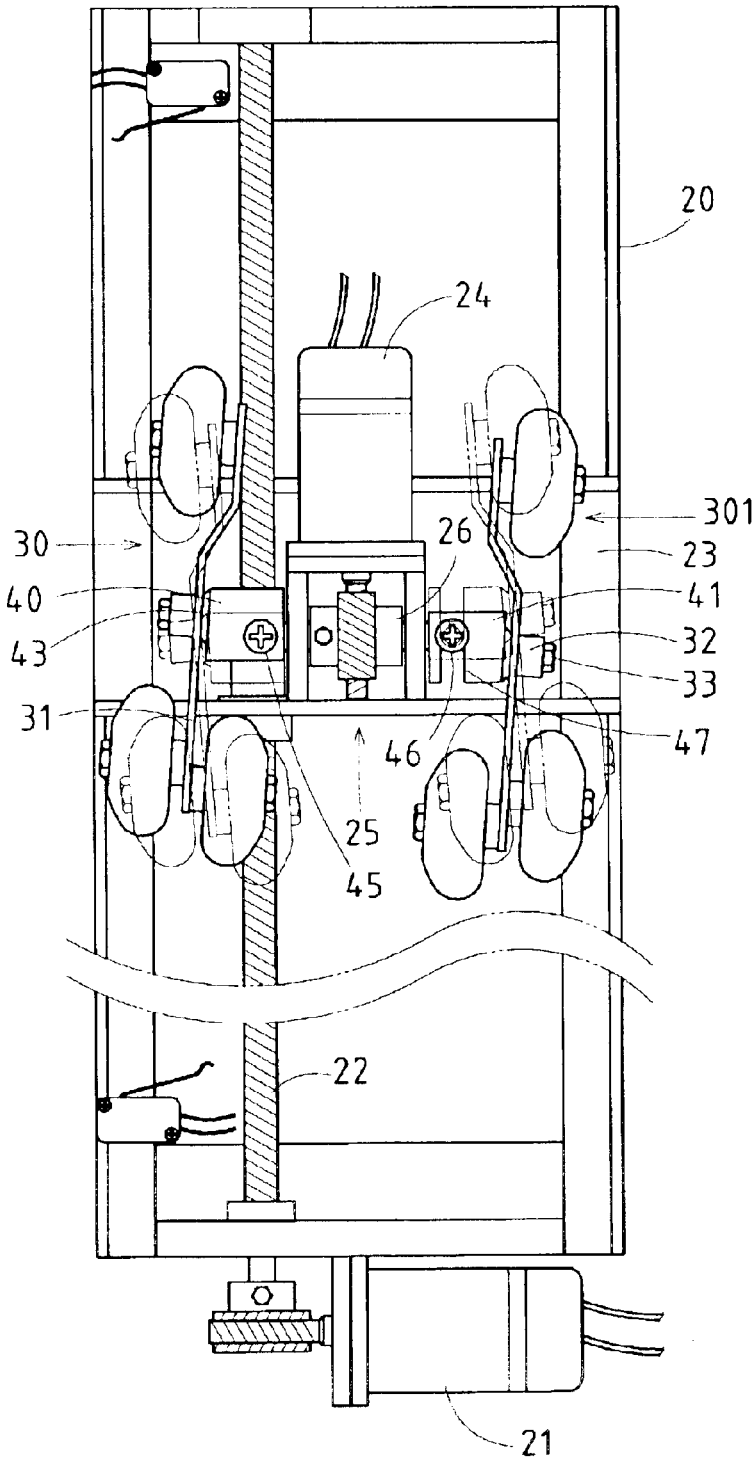
FIG. 5 plan schematic of this creation in parallel rocking movement mode.
Figure 6A:
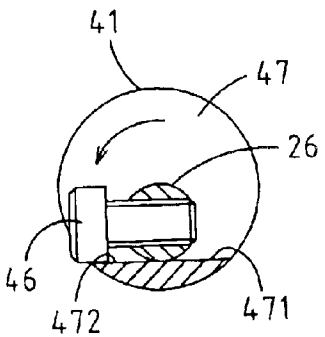
FIG. 6 structure section view of this creation in symmetric kneading movement mode and FIG. 6A partially plan cross-sectional view of FIG 6.
Figure 6:
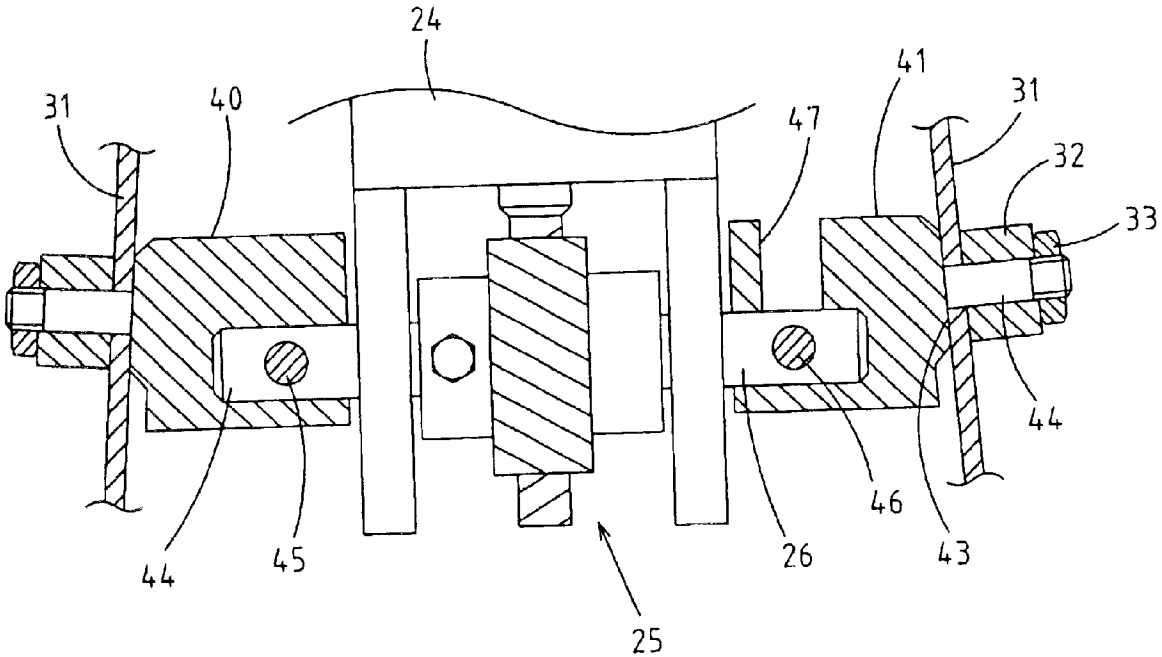
Figure 7:
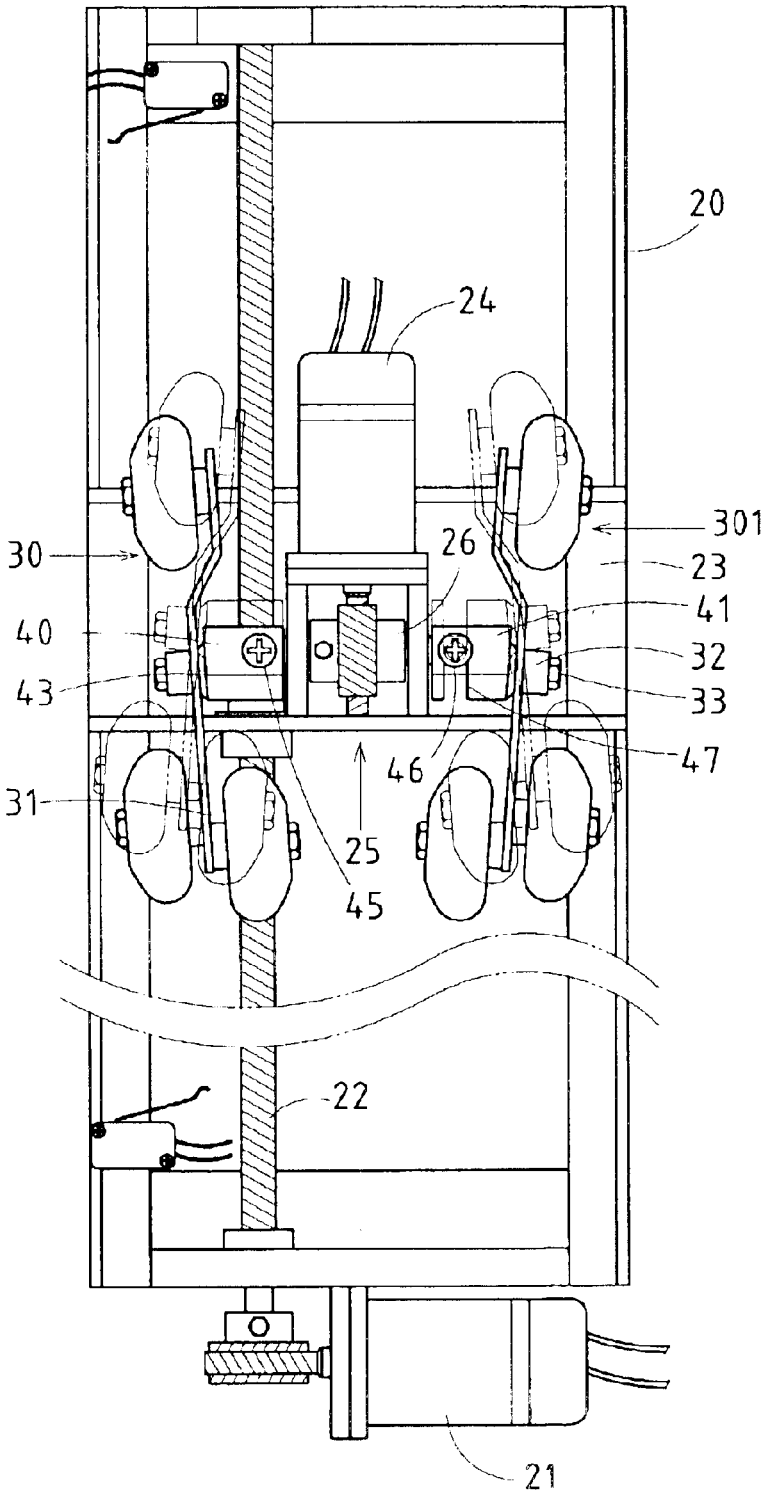
FIG. 7 plan schematic of this creation in symmetric kneading movement mode.

When the roller massager of this creation is started, the sliding seat 23 slides up and down, back and forth through the rotation of the worm 22 as driven by the drive motor 21, while the drive rod 26 can also rotate clockwise, counterclockwise by way of the second drive motor 24. Since both pilot end heads 40, 41 are eccentrically fitted onto the drive rod 26, while the rocker arms 31 of the massaging roller sets 30, 301 are pivot-fitted onto the studs 44 on the inclined end surfaces 43 at the outer side of the pilot end heads 40, 41, these allow the rocker arm 31 to generate up and down movements as well as right and left swinging movements simultaneously along with the rotation of the drive rod 26. Moreover, the pilot end head 41 is capable of rotating 180° freely in both clockwise and counterclockwise directions through the provision of the slot 47, thus it can automatically adjust its stopping angle depending on the clockwise, counterclockwise rotations of the drive rod 26. As demonstrated in FIG. 4, when the drive rod 26 rotates clockwise coming to being stopped by the bolt 46 at the clockwise extreme end 471 of the slot 47, as a result, such an attitude will be generated between the pilot end head 41 and another pilot end head 40 that they will be at different heights yet their inclined end surfaces 43 are at parallel angles; by way of this, as shown in FIG. 5, the massaging roller sets 30, 301 at two ends will be in a mode of parallel rocking movements; furthermore, as indicated in FIG. 6, when the drive rod 26 rotates counterclockwise and is stopped by the bolt 46 at the counterclockwise extreme end 472 of the slot 47, consequently, such an attitude will be formed between the pilot end head 41 and another pilot end head 40 that they will be at identical heights while their inclined end surfaces 43 are in symmetric positions, through this, as illustrated in FIG. 7, the massaging roller sets 30, 301 at two ends will appear in a kneading mode of opposite movements. From the above, it can be seen that, in this creation, through improvements on the structure design for those two pilot end heads, besides optimal massaging effects of up and down movements can be achieved due to the feature of eccentric fitting, a special structure feature arising from the self rotation of the pilot end head at one end thus altering its relative attitude with the pilot end head at another end further enables automatic switching between two massaging movement modes of rocking and kneading; as a result, better and more comfortable massaging effects in comparison with the customarily adopted technology can therefore be achieved.

What is claimed is:

1. A roller massager structure comprising: a seat body; a first drive motor; a sliding seat; a second drive motor; rocker arms having massaging roller sets;

wherein the sliding seat is matched with a worm allowing it to slide back and forth along with the worm rotatable by the first drive motor; wherein the second drive motor rotates a drive rod through a turning gear set; wherein the rocker arms are pivotally connected at the ends of the drive rod; and two pilot end heads eccentrically installed at the ends of the drive rod comprising: inner sides, each inner side having an eccentric hole for fitting on the drive rod ends; and outer sides, each outer side having an inclined end surface with a projecting stud to limit the positions of the massaging rocker arms through a locking set including a lining ring and a nut after the rocker arm being pivotally connected to the stud;

wherein the two pilot end heads are radially locked onto the drive rod by bolts, each pilot end head is further provided with a radial slot cutting across the eccentric hole, the radial slot having clockwise and counter-clockwise extreme ends that are positioned such that the pilot end head will be limited by the bolt after rotating 180°; and whereby one pilot end head can rotate clockwise or counter-clockwise depending on the different rotating directions of the drive rod, thus alternating its relating height and inclined end surface altitude with respect to the pilot end head at the other end of the drive rod, thereby generating parallel rocking or symmetric kneading massaging movements.

* * * * *